US007226308B1

(12) United States Patent
Hanks

(10) Patent No.: US 7,226,308 B1
(45) Date of Patent: Jun. 5, 2007

(54) COMPRESSION SNAP ELECTRICAL CONNECTOR

(75) Inventor: Rip Hanks, Gulf Breeze, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 4 days.

(21) Appl. No.: 11/420,646

(22) Filed: May 26, 2006

(51) Int. Cl.
*H01R 4/24* (2006.01)

(52) U.S. Cl. ..... 439/427; 439/393; 29/857

(58) Field of Classification Search ..... 439/427–429, 439/393, 401, 784, 805, 807; 29/857, 861
See application file for complete search history.

(56) References Cited

U.S. PATENT DOCUMENTS 3,249,908 A * 5/1966 Fuller et al. ..... 439/393
3,304,447 A * 2/1967 Lindt ..... 310/71
5,228,875 A 7/1993 Swenson, Sr.
5,695,369 A 12/1997 Swenson, Sr.
5,868,589 A 2/1999 Swenson, Sr.
5,934,943 A 8/1999 McCarthy
6,126,491 A 10/2000 McCarthy
6,358,103 B1 3/2002 Tomasino
6,488,548 B1 12/2002 Tomasino
6,494,753 B1 12/2002 Tomasino
6,568,952 B1 5/2003 Tomasino
6,692,213 B1 2/2004 Tomasino
6,695,653 B1 2/2004 Tomasino
6,796,829 B1 9/2004 McCarthy
6,796,853 B1 9/2004 Tomasino
6,814,630 B1 11/2004 Tomasino
6,830,491 B1 12/2004 Tomasino
6,851,966 B1 2/2005 Tomasino
6,857,895 B2 2/2005 Korte et al.
6,866,550 B1 3/2005 Tomasino
6,890,208 B2 5/2005 McCarthy
2003/0207610 A1* 11/2003 Lindemann et al. ..... 439/427
2004/0192121 A1 9/2004 Tomasino

* cited by examiner

*Primary Examiner*—Hien Vu
(74) *Attorney, Agent, or Firm*—Momkus McCluskay; Jefferson Perkins

(57) ABSTRACT

An electrical connector has a connector body with a bore and a cap through which a stranded insulated conductor is threaded. A ridge in the external surface of the cap engages with at least one groove in the bore to secure the conductor in place. Preferably, there are at least two such grooves in the bore at different axial positions, and the cap is axially advanced from one such groove to another one farther inside the bore to effect full physical and electrical connection.

22 Claims, 9 Drawing Sheets

COMPRESSION SNAP ELECTRICAL CONNECTOR

BACKGROUND OF THE INVENTION

There are many electrical connectors which are known from the published prior art or the marketplace. These connectors seek to connect together electrical conductors without soldering and often without the use of tools. Connectors exist for multistranded insulated wires or cables as well as coaxial cables.

Several such connectors are sold by Swenco Products, Inc. under the mark POSI-LOCK®. Many of these connectors are illustrated in U.S. Pat. Nos. 5,228,875; 5,868,589; 6,358,103 B1; 6,494,753 B1; 6,568,952 B1; 6,692,313 B1; 6,695,653 B1; 6,814,630 B1; 6,830,491 B1; 6,851,966 B1; 6,866,550 B1; and U.S. Patent Application Pub. No. US2004/0192121 A1. These connectors usually require stripping the insulation off of a terminal portion of the wire, and all are connected together by twisting a cap onto a connector body. But helical twisting motions of a multistranded conductor as it is being connected often torsionally stress the metallic strands sought to be connected, resulting in a less than optimum physical and electrical connection. A need therefore persists for connectors which can make a secure electrical connection to a multistranded insulated electrical conductor without twisting one part onto another.

SUMMARY OF THE INVENTION

According to one aspect of the invention, an electrical connector is provided which includes a body with a bore having an axis, and a cap through which a multistranded electrical conductor is threaded. A sidewall of the bore body has a first groove spaced inwardly from an open end of the bore, and at least a second groove spaced inwardly in the bore from the first groove. A ridge in the cap is adapted to be received in either of the first and second grooves in the bore of the body. In order to complete a connection of the conductor to a conductive element disposed in the bore of the body, the cap and conductor are advanced into the bore from the first groove until the cap ridge is seated in the second groove.

Preferably, either or both of the first and second grooves are constituted by a shoulder or step at which the interior diameter of the bore increases, and a beveled surface extending from this step axially inwardly into the bore of the body and extending radially inwardly. The ridge of the cap is formed in somewhat complementary fashion, such that a beveled surface of the cap engages one of the beveled surfaces of the first and second grooves.

In a further aspect of the invention, an electrical connector includes a body with a bore and a cap. At least one groove is formed in the sidewall of the bore to be spaced axially inwardly from an open end of the bore. The groove has a second internal diameter which is larger than a first internal diameter taken across the bore entrance. A conductive element of the connector body extends from a bottom of the bore and has a beveled surface that, as one proceeds down the bore, slopes radially outwardly. A ridge in the cap is adapted to fit into or register with the groove in the body bore.

An inner bore of the cap has a beveled surface which engages with the beveled surface of the conductive element. An insulated multistranded conductor has insulation removed from an end portion thereof. This conductor is threaded through the cap. Connection is made by advancing the cap down the bore until a ridge on the cap snaps into or registers with the groove on the bore. When this happens, conductive strands of the stripped end of the conductor will be compressed between the inner beveled surface of the cap bore and the beveled surface on the conductive element in the body bore.

In one variation of this embodiment, the interior of the cap includes a constriction beyond which only the stripped conductor can extend, and a set of threads or rings axially outwardly adjacent this restriction for threaded or other sealing engagement to the insulation. In another variation that is alternative or cumulative to this, an o-ring in the cap bore seals to the insulation of the conductor.

In a further aspect of the invention, an electrical connector is provided which has a connector body with a bore and at least one groove therein, and a cap. The bore is defined by a sidewall which includes a beveled portion that is sloped so as to be more constricted as one proceeds in an axial direction to a bore bottom. The cap has a general outer surface which is substantially parallel to the bore/cap axis and a ridge which extends radially outwardly from this general outer surface. This ridge is adapted to register with the groove in the conductor body bore when electrical connection is completed.

In this embodiment, slits are formed to extend backwardly from an inner axial end of the cap. A conductor is threaded through the cap and impaled onto a conductive element disposed in the bore of the body. As the cap is advanced down the bore, the slits of the cap are compressed radially inwardly by a beveled surface in the bore body, clamping the conductor in place.

BRIEF DESCRIPTION OF THE DRAWINGS

Further aspects of the invention and their advantages can be discerned in the following detailed description, in which like characters denote like parts and in which.

DETAILED DESCRIPTION

Figure 1A:
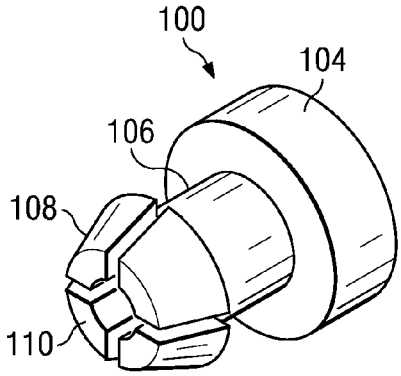
FIGS. 1A–1D are isometric, top, front and axial sectional views of a cap or plug according to a first embodiment of the invention.
Figure 1B:
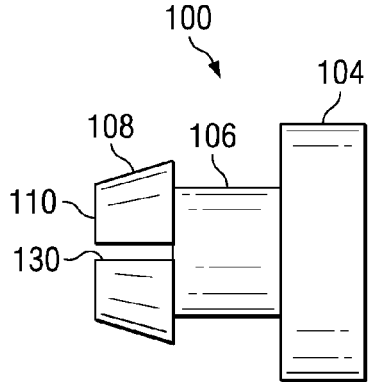
Figure 1C:
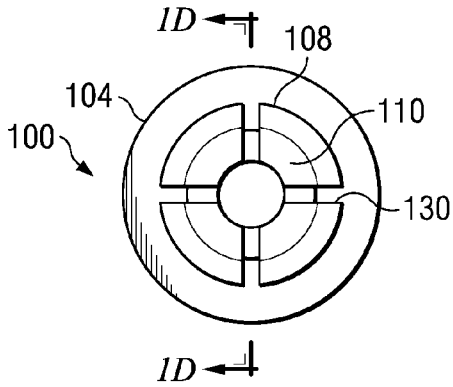
Figure 1D:
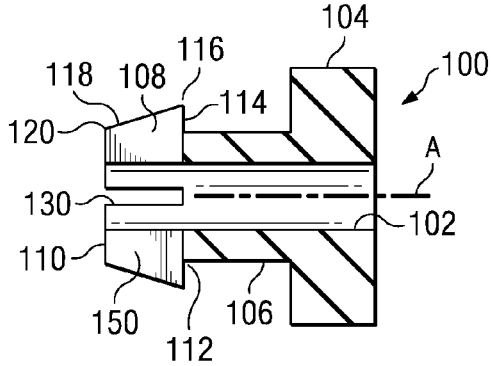

Referring first to FIGS. 1A–1D and 2A–2D, in a first embodiment of the invention, a connector body 200 has a generally cylindrical external shape. Throughout these illustrated embodiments, it should be understood that the body 200 and its analogs can be plastic, metal, or any other suitable material; body 200 does not have to be conductive. The body 200 has a bore 202 with an open end 204 and a generally cylindrical interior sidewall 206 which terminates in a bottom 208. The body 200 and the bore 202 are conveniently formed around an axis A. The body 200 preferably should be formed of a material that is somewhat elastic, so that it will stretch slightly and snap back during stages of insertion of the cap and conductor into the bore 202, as will be later described. But the body 200 should not be so elastic that the connection will easily fail because of the cap being pulled back out of the connector body.

The bottom 208 of the bore 202 has a central hole 210 through which is inserted a conductive element 212, in the illustrated case a pin connector. The conductive element 212 alternatively could be a spade connector, a battery terminal or any other shape adapted for connection to further electrical apparatus. In the illustrated embodiment, the conductive element 212 has a flange or base 214 which tightly fits to the sidewall 206 and is adapted to rest on the bottom 208 of the bore. In an alternative embodiment the conductive element 212 could have one or more radial processes meant to be in-molded into the back wall 216 of the body 200, as will be shown in other embodiments herein. The conductive element 212 has an upstanding and coaxial pin or prong 218 which extends from the bottom 208 axially outwardly toward the bore open end 204. The pin 218 preferably is beveled or pointed at its free end 220 so as to be adapted to impale the conductive strands of a multistranded insulated conductor 222, seen in FIGS. 2E and 2F. In this embodiment, the diameter of pin 218 is relatively small and, after its beveled or sharpened point 220, stays substantially constant until it joins with base or flange 214.

While bore 202 is generally cylindrical (or alternatively prismatic), it is not completely so. Importantly, the bore 202 has at least one, and in this embodiment two, grooves 224 and 226. The groove 224 is axially spaced away from the bore opening 204 and, at its greatest extent, has an inner diameter perpendicular to the axis A which is greater than the inner diameter across the opening 204. In the illustrated embodiment, the groove 224 is formed by a step or shoulder 228, at which the groove 224 begins to depart from the general coaxial and cylindrical surface 206 of the bore 202. The step or shoulder 228 extends from a point 229 radially outwardly by a predetermined distance to a radially outward end 230 thereof. Starting at point or end 230, a beveled surface 232 proceeds axially inwardly and radially inwardly for a predetermined distance until it terminates at point or end 234. In the illustrated embodiment, the shoulder 228 and the beveled surface 232 are surfaces of rotation around axis A. A diameter taken across the axis at point 234 is significantly less than the diameter taken at point 230. In this embodiment, the groove 224 is formed by a flat surface 228 and a frustoconical surface 232. The groove 224, which as will be explained acts as a detent or positioner for a cap, can take a form different from that shown; for example it can instead be formed by one or more curved surfaces.

In the illustrated embodiment, the first groove 224 is accompanied by a second groove 226 that is spaced down the bore 202 from groove 224, thus defining distinct axial positions in the bore 202. In this embodiment, the surfaces forming groove 226 are immediately adjacent those forming groove 224, although it could be otherwise. A step or shoulder 236 begins at point 234 and proceeds radially outwardly by a predetermined distance until point 238, at which it ends and a beveled surface 240 begins. The beveled surface 240 proceeds axially inwardly (that is, toward bottom 208) and radially inwardly (toward axis A) until point or end 242. At point 242, in the illustrated embodiment the generally cylindrical surface 206 resumes and continues to the bottom 208. A diameter taken across the axis at point 238 is greater than a diameter taken across the axis at point 242. Like groove 224, groove 226 in the illustrated embodiment is formed by two surfaces of rotation around axis A, a flat surface 236 disposed in a plane orthogonal to the axis, and a frustoconical surface 240 adjoining surface 236. But groove 226 could be formed by other surfaces. Like groove 224, groove 226 acts as a detent or positioning means for the connector cap and other surfaces (such as curved ones) could instead be provided for this purpose. Further, while in this illustrated embodiment grooves 224 and 226 are shown to be continuous or endless, and circumferentially extend around the entirety of the connector bore sidewall 206, grooves 224 and 226 could instead be discontinuous or even be made up of disconnected portions, and still be able to perform their cap-detenting or positioning function.

The cap 100 for this embodiment is illustrated in FIGS. 1A–1D. The cap 100 has a bore or through-hole 102 adapted to receive the multistranded conductor 222 (seen in FIGS. 2E and 2F). In this illustrated embodiment, most of the surfaces of cap 100 are formed as surfaces of rotation around the axis A. An outer axial end 104 of the illustrated embodiment is enlarged, such that its outer diameter across the axis is greater than the inner diameter across connector body bore entrance 204 (see, e.g., FIG. 2D). The cap 100 has a central portion 106 of cylindrical shape whose external diameter is less than that of outer axial end 104, and which is also less than the respective inner diameters taken at points 229 and 234 inside bore 202 of connector body 200. The cap 100 further has an enlargement or ridge 108 formed somewhere on its external surface, in this illustrated embodiment adjacent its axial inner end 110. Ridge 108 has an outer diameter at its greatest extent which is greater than the inner diameter of the bore entrance 204.

In this embodiment, the ridge 108 is formed by two surfaces of rotation which are roughly complementary to the surfaces forming grooves 224 and 226. Starting at point 112 on the generally cylindrical middle section 106, a flat, annular surface 114 projects radially and orthogonally outwardly to a point 116. Point 116 marks the end of a frustoconical surface 118, which extends axially inwardly (that is, toward the bottom 208 of bore 202 when the cap 100 is being used) and radially inwardly to a point 120, which in this embodiment the same radial distance away from the axis A as is surface 106. In the illustrated embodiment point 120 happens to be a portion of inner axial end 110 of cap 100, but the ridge-creating surfaces 114, 118 can be positioned anywhere on the exterior surface of cap 100 (with commensurate adjustments of the positions of grooves 224, 226).

The angle of bevel of frustoconical surface 118 does not have to be the same as the angles of connector body frustoconical surfaces 232, 240, and in one commercial embodiment they in fact are different. The first frustoconical surface 232 can be selected to somewhat loosely receive the cap surface 118. On the other hand, the second connector body frustoconical surface 240 can be selected to induce a camming effect on the surface 118; as will be later described herein, the surface 240 can be relatively steep so as to force the leaves of a split surface 118 radially inwardly to grip the conductor insulation.

The cap 100 can be formed of plastic, metal or any other suitable material. It preferably is somewhat elastic, that is, it will deform and return to its initial shape after the deforming force is removed. This elasticity permits the cap to "snap" to either of the grooves 224, 226 after being forced beyond body bore sidewall constrictions in front of them. Conveniently, both cap 100 and connector body 200 can be injection-molded using a thermoplastic or thermosetting polymer.

In this embodiment, the cap 100 has at least one, and more preferably a plurality (such as four) slits or openings 130 which extend from the inner axial end 110 of cap 100 axially outwardly for a predetermined distance. In the illustrated embodiment, the slits 130 are each arranged to lie in planes including axis A, but they don't need to be; preferably, they should extend at least roughly longitudinally. In the illustrated embodiment, the slits 130 extend for the same distance as, and are limited to, the frustoconical surface 118, but conceptually the positioning of slits 130 and of ridge 108 are entirely independent of each other, as they do separate jobs. The function of ridge 108 is to index the cap 100 to one of the connector body grooves 224, 226; the function of the slits 130 is to permit the portion of cap 100 adjacent inner axial end 110 to compress inwardly. In the illustrated embodiment the slits 130 are rectangular in shape but they could also be triangular or take another shape whereby more material is removed the farther one proceeds inwardly on the axis A.

Figure 2A:
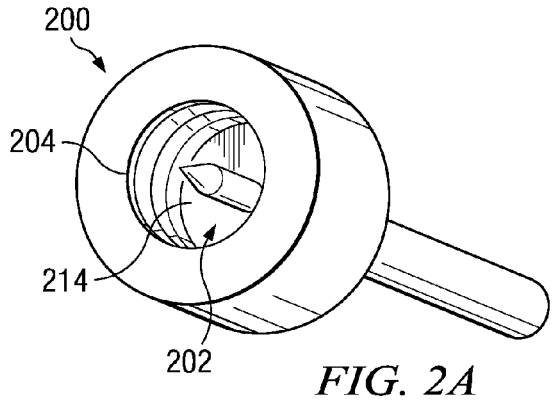
FIGS. 2A–2D are isometric, side, front and axial sectional views of a connector body for use with the cap shown in FIGS. 1A–1D.
Figure 2B:
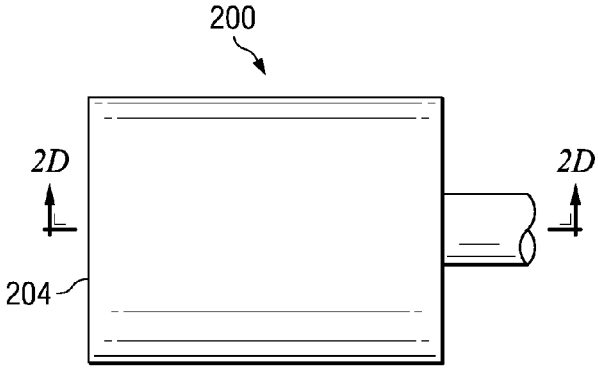
Figure 2C:
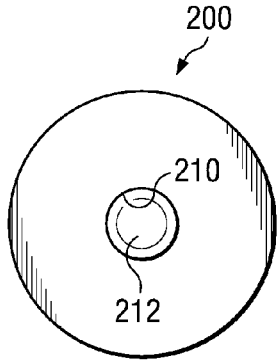
Figure 2D:
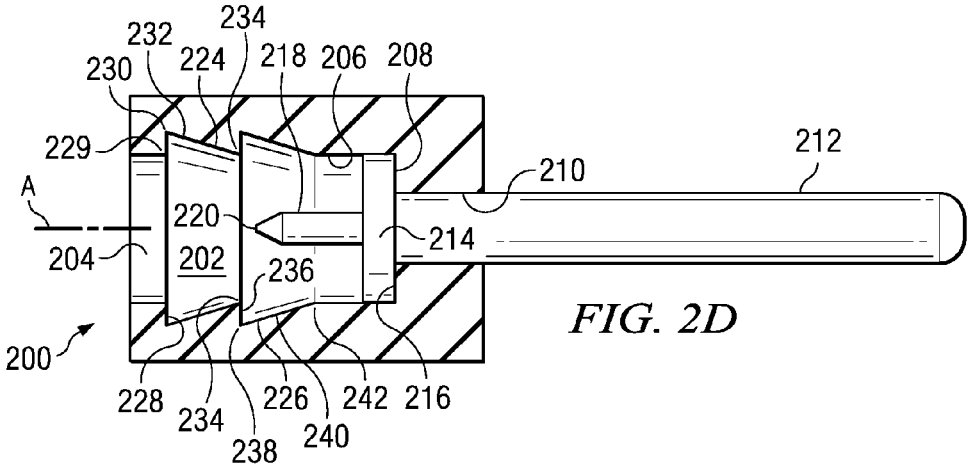
Figure 2E:
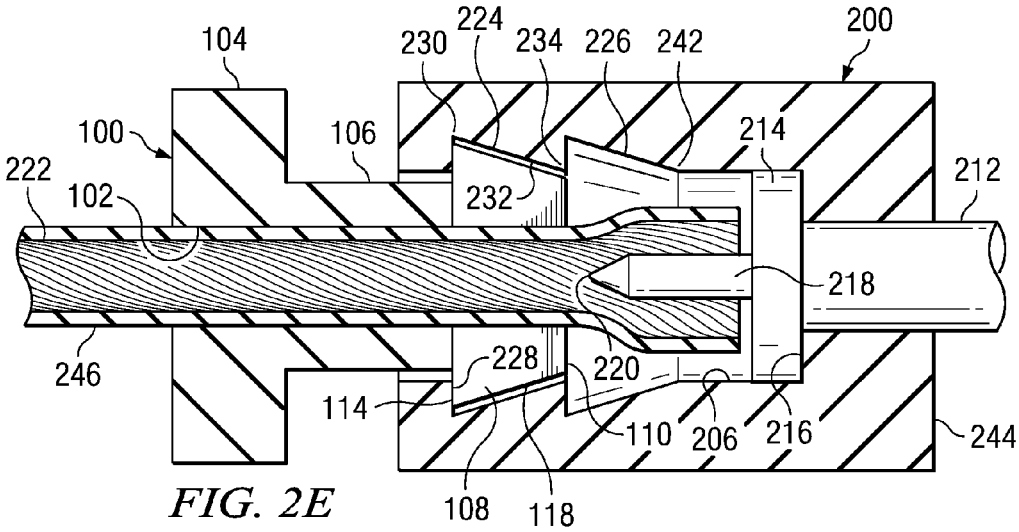
FIGS. 2E and 2F are axial sectional views of the cap and connector introduced in FIGS. 1A–2D, showing two successive stages in the connection of a multistranded conductor.
Figure 2F:
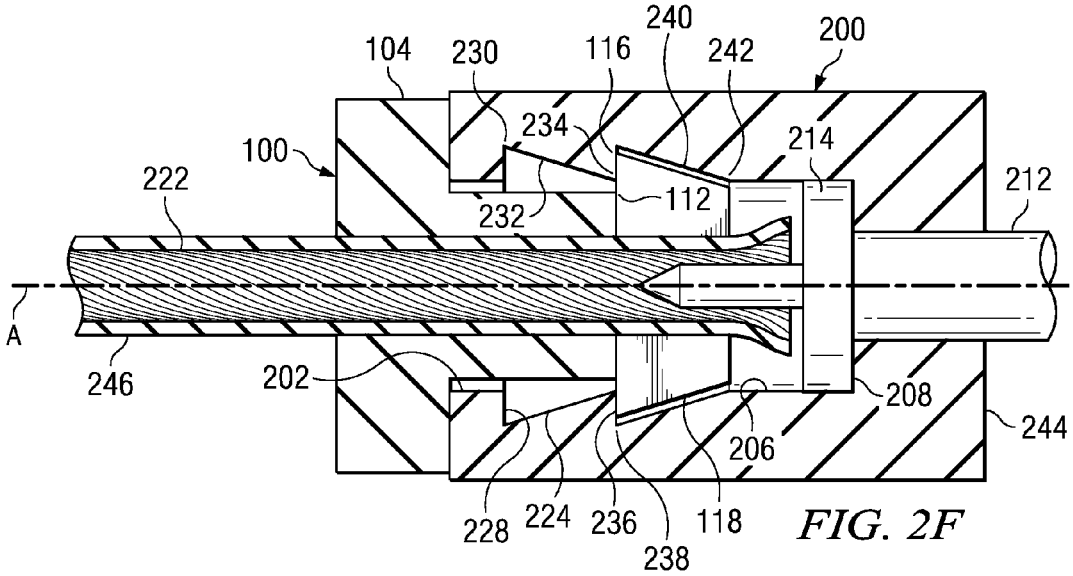

FIGS. 2E and 2F illustrate the operation of the slit-cap embodiment of the invention introduced by FIGS. 1A–1D and 2A–2D. Prior to the time shown in FIG. 2E, a multi-stranded insulated conductor 222 is inserted through the bore of cap 100 and is impaled on prong 218. The outside jacket 246 of the insulated conductor 222 may be marked at measured intervals which would allow the user to know when the conductor has been inserted by a correct length, instead of assuming that the conductor has been pushed in far enough because it feels bottomed out. The markings preferably would occur in pairs: a first mark would show where the end of the conductor should be cut, and a second mark, at a predetermined distance away from the first, would show the amount of conductor to be inserted into the connector. In one embodiment, the cap-connector combination 100, 200, 212 is provided to the end user as a single unit, and in this instance the conductor 222 is inserted through the cap bore 102 while the cap 100 is in the position shown, in which the cap ridge 108 is detented to the first groove 224 in the connector body 200. In another embodiment, the conductor 222 is inserted into the bore 202 prior to the insertion of cap 100 into same.

The cap 100 is then advanced inwardly along axis A from groove 224 to groove 226. The ridge 108 will seat into or snap into place inside groove 226 and will thus indicate to the user that the cap 100 has been pushed down the bore 202 far enough. Forcing the cap 100 further into bore 202 from first groove 224 could, in some embodiments, be done manually; in other embodiments and particularly where a permanent connection is wanted that will exhibit a large amount of strain relief, a plier (not shown), preferably one with a stop to prevent overcompression, may be used to compress ends 104, 244 toward each other until ridge 108 of the cap 100 is seated in the groove 226 of the bore 202.

As this is being done, the frustoconical surface 118 is forced radially inwardly, such that that portion of the internal cap sidewall between the slits 130 will grip the insulation 246 of the conductor 222. The frustoconical surface 118 is cammed inwardly by being forced against frustoconical surface 240 of the second groove 226. The resultant gripping by cap 100 of the conductor 222 aids in strengthening the physical connection. In another embodiment (not shown), a further beveled surface inside the body bore 202 may coact with the slit end 110 of cap 100, while ridge 108 may be placed at a more axially outward position on the exterior surface of cap 100. The position of detenting of indexing grooves 224, 226 would also be more axially outward and frustoconical surface 240 would have a detenting function, but would no longer have a cap end-compressing or camming function.

Figure 3:
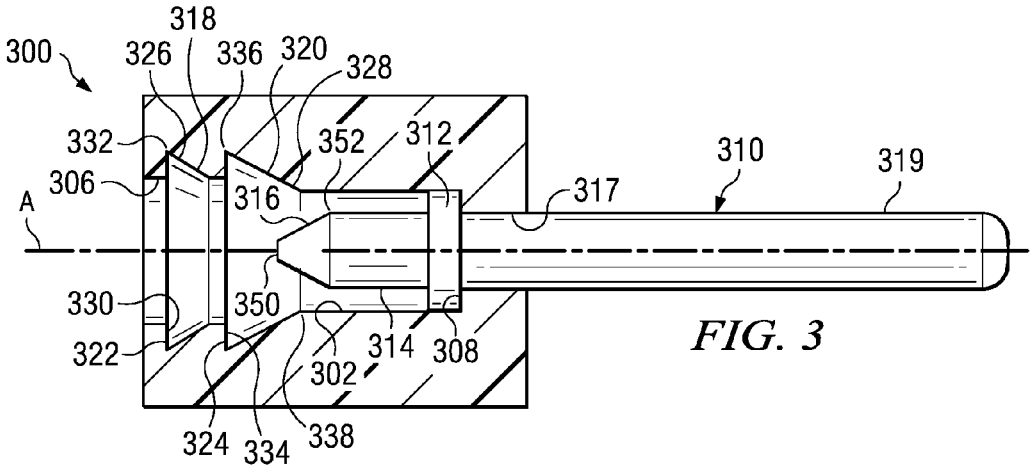
FIG. 3 is an axial sectional view of a connector or terminal body according to a second embodiment of the invention.

FIGS. 3 and 4A–4D illustrate an embodiment alternative to the "split-cap" embodiment shown in FIGS. 1A–1D and 2A–2F. In FIG. 3, a connector body 300 has a generally cylindrical exterior and a generally cylindrical bore 302, which extends from an axially outward opening 306 to a bottom 308. As before, a conductive element 310 has a base 312 which fits tightly within bore 302 and is seated on bore bottom 308. A prong or pin 314 of conductive element 310 has a reduced diameter and extends into the bore in an axially outward direction. But this prong 314 is terminated in a conical or frustoconical surface 316 that extends between respective outer and inner axial margins or ends 350, 352 thereof. The conductive element 310 extends through a central hole 317 in the bottom 308 and may, for example, terminate as the illustrated jack or pin 319. The connector body 300 (which doesn't have to be conductive) also has two grooves 318, 320 at different axial positions within bore 302. The grooves 318, 320 are formed in this illustrated embodiment by radially and orthogonally extending annular surfaces 322, 324 and adjacent frustoconical surfaces 326, 328, respectively. As in other embodiments the grooves 318, 320 could be formed by surfaces other than those shown.

The outer opening 306 has a first inner diameter until point 330, from which annular surface 322 proceeds radially outwardly until point 332. The frustoconical surface 326 extends from point 332 radially and axially inwardly to a point or locus 334. In this illustrated embodiment, the two grooves 318, 320 are formed to adjoin each other, so locus 334 also forms an inner end of annular surface 324. Annular surface 324 extends radially and orthogonally outwardly to locus 336. The second frustoconical surface 328 extends from locus 336 radially and axially inwardly to point or locus 338. The rest of the bore 302 takes a constant diameter as one proceeds inwardly from point 338; the diameter of bore 302 in this innermost section is smaller than a diameter taken at opening 306, as the opening 306 is adapted to receive an insulated multistranded conductor 222, while the inner section of bore 302 is only meant to receive the stripped strands 340 of the conductor 222 (see FIG. 4C).

Figure 4A:
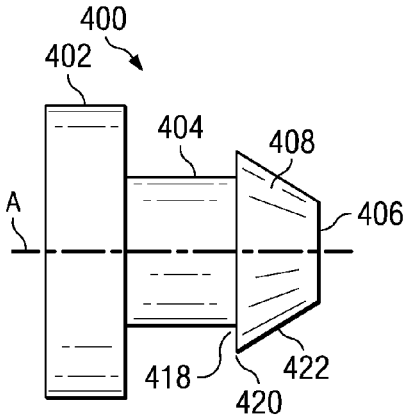
FIGS. 4A and 4B are side and axial sectional views of a cap or plug which is adapted for use with the connector body shown in FIG. 3.
Figure 4B:
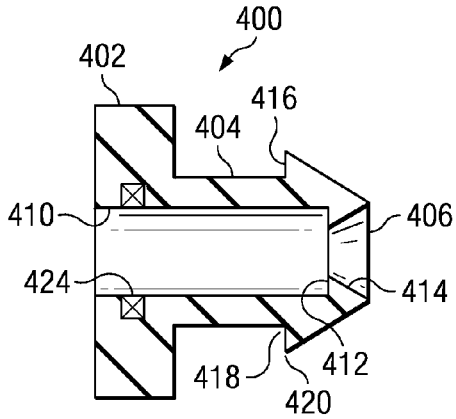

The cap 400 for this embodiment is shown in FIGS. 4A and 4B. Cap 400 has an enlarged axial outer end 402, a middle section 404 and an axial inner end 406 with (in this embodiment) an adjoining ridge 408. A substantially cylindrical inner bore 410 begins at end 402 and proceeds through middle section 404, until it terminates at an internal constriction or shoulder 412. From shoulder 412, a beveled surface 414 extends radially outwardly and axially inwardly until axial inner end 406 of cap 400. It is not necessary that beveled surface 414 in cap bore 410 be at the inner axial end 406 of cap 400; surface 414 could instead be recessed by a terminal cylindrical bore (not shown) that would join surface 414 to the inner end 406 of the cap.

Further, ridge 408 in the illustrated embodiment adjoins the axial inner end 406, but this could be chosen otherwise. As in the previously described embodiments, the function of the ridge 408 is to detent or register the cap 400 at least one, and preferably at one of at least two, separate axial positions inside of the bore 302 of the connector body 300; the ridge 408 could be moved to any location on the external surface of the cap 400 as may be convenient, with the positions of grooves 318, 320 being changed commensurately.

In this embodiment the ridge 408 is formed by the junction of two surfaces of rotation around axis A: an annular surface 416 which lies in a plane orthogonal to the axis A, and which extends from a point or locus 418 on the middle section 404, to a point or locus 420 radially outward therefrom. From point 420, a frustoconical surface 422 extends radially and axially inwardly until its termination at end 406. The ridge 408 could instead be formed by other surfaces, such as curved ones.

This illustrated embodiment also includes an o-ring 424 located in the axial outer end 402 of cap 400, so as to seal to the insulation of the connected electrical conductor. The o-ring can take the form of a toroidal elastomeric ring seated in a groove on the inner bore 410 of the cap, or alternatively could be an integral, injection-molded portion of the cap that is formed before or after the remainder of the cap 400, as would occur in a double-shot injection molding process. The o-ring 424 (which instead may be square or rectangular in cross section) may be positioned at various positions along the bore 410, any of which will perform the function of sealing the cap to the conductor insulation 246 (see FIGS. 4C and 4D). This and other embodiments may in addition or in substitution be furnished with an o-ring 440 which rides on surface 404 and which will be compressed between cap enlargement 402 and the outer axial end face 442 of connector body 300 when the cap 400 is fully inserted therein. The o-rings 424, 440 or analogous structures may be provided with any other embodiment of the invention, including the other embodiments described herein or illustrated in the appended drawings.

Figure 4C:
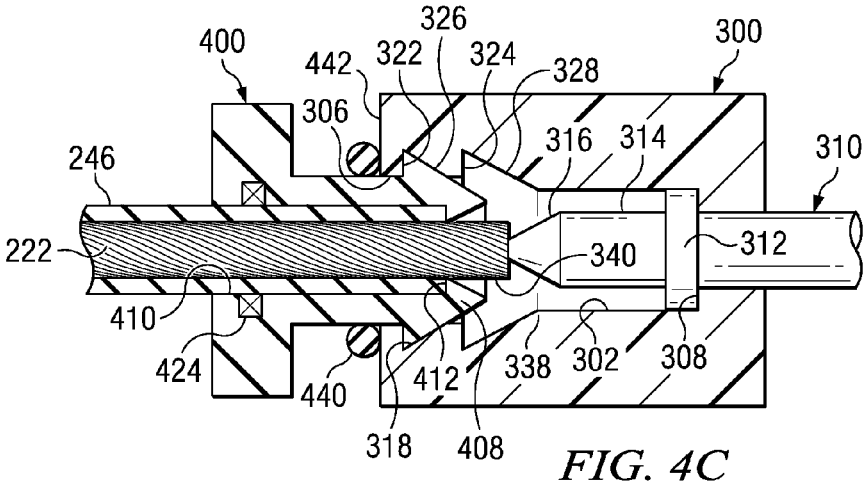
FIGS. 4C and 4D are axial sectional views of the cap and connector body shown in FIGS. 3, 4A and 4B, showing stages in connecting to a multistranded electrical conductor.
Figure 4D:
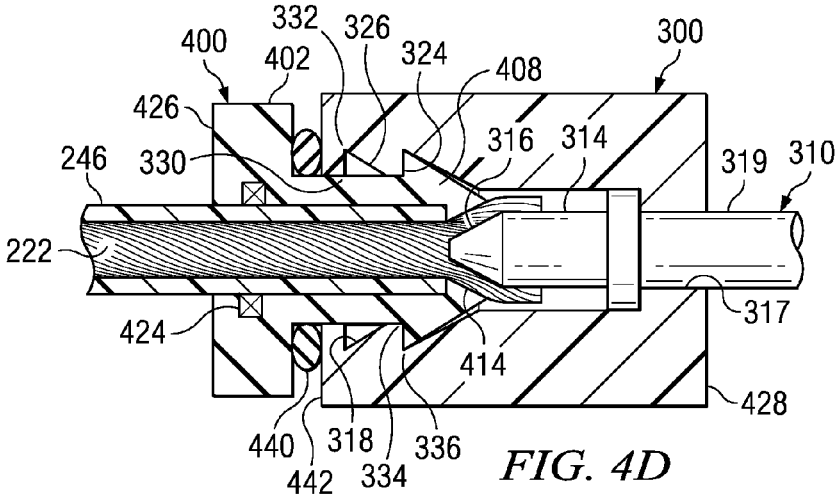

The operation of this embodiment is shown in FIGS. 4C and 4D. A multistranded insulated conductor 222 has its external insulation 246 stripped for a predetermined length from its end. The predetermined length can be given in user instructions. Alternatively, the invention may be provided in kit form with the conductor to be connected, the latter being marked on the external surface of its insulation 246 to show how far the insulation should be stripped. In another alternative, the conductor 222 may come pre-stripped, or a special insulation stripping tool (not shown) may be provided that will strip only a predetermined terminal portion of the insulation off of the end of the conductor.

The conductor 222 is then inserted into the bore 410 of the cap 400, past the o-ring 424, until the end of its insulation 246 abuts the internal shoulder 412. In the illustrated embodiment, the connector and the cap come to the user preassembled to each other, wherein the ridge 408 is registered with first groove 318 prior to the insertion of the stripped conductor 222 therein. After the conductor 222 is advanced into the bore 410 until it reaches shoulder 412, the cap 400 and the conductor 222 are advanced together further down the bore, until the ridge 408 "snaps" to or registers or seats with the second groove 320. In one embodiment, this could be done manually, but more force can be applied more precisely with a plier-like tool (not shown) which would compress end surface 426 of cap 400 and opposing end surface 428 of the connector body 300 until a stop in the plier is reached. When the ridge 408 is registered to the inner groove 408, the stripped strands 340 will spread around the frustoconical end surface 316 of the prong 314, so as to be wedged between the outwardly beveled surface 316 and the inwardly beveled surface 414 of the cap 400. In this embodiment, it is desirable that the outwardly beveled surface 316 and the inwardly beveled surface 414 be shaped to be mating surfaces to each other. The precise shape can be different from that shown, so long as both are altered concomitantly; for example, surfaces 414, 316 can be curved surfaces, with one being convex and the other concave, or vice versa.

Figure 5A:
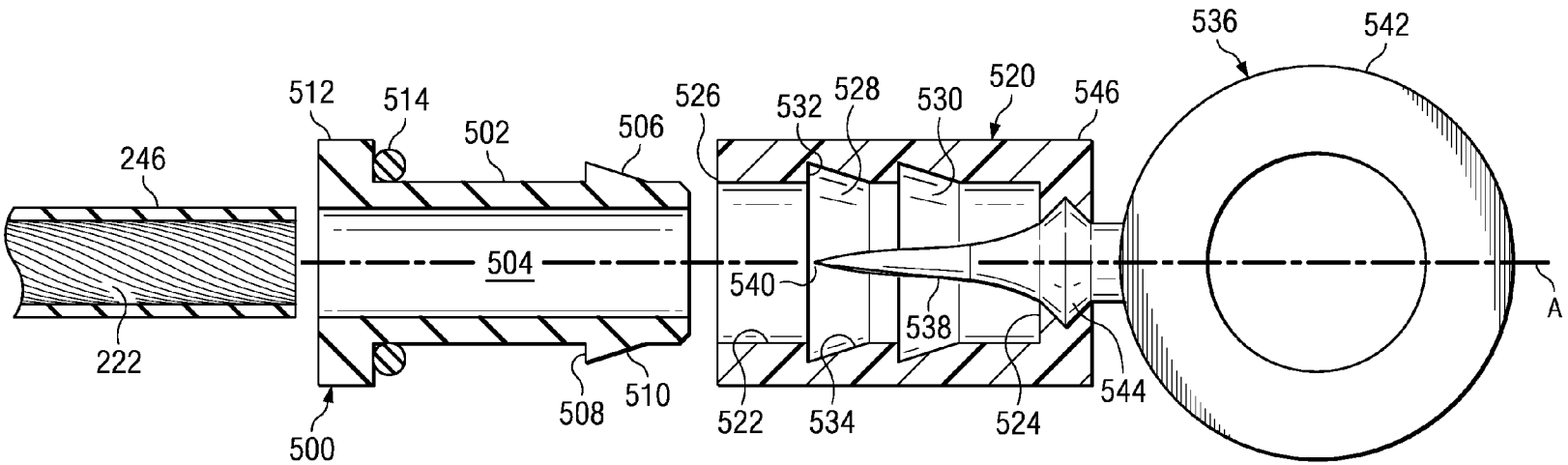
FIG. 5A is an axial sectional view of a cap and connector body according to a third embodiment of the invention, shown with an end of an insulated multistranded conductor to be connected.
Figure 5B:
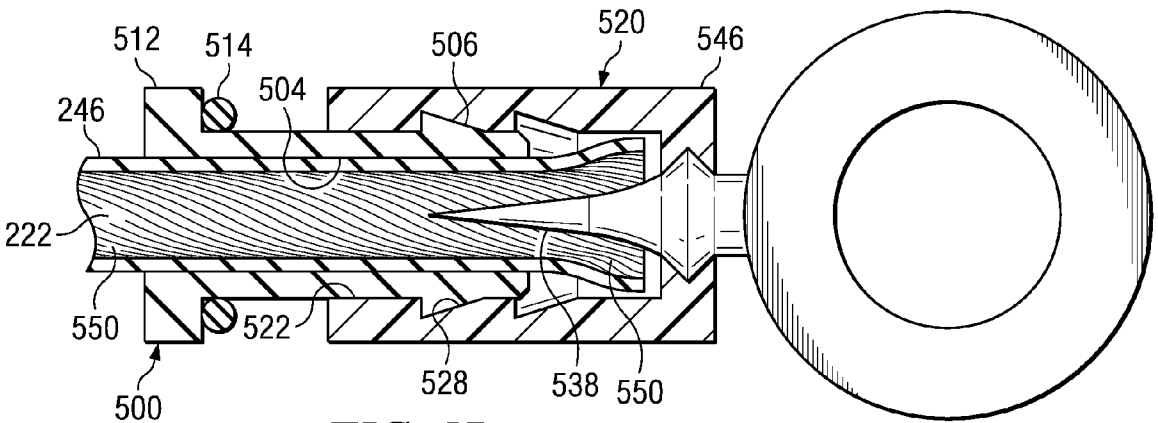
FIGS. 5B and 5C are axial sectional views of the cap, connector body and conductor shown in FIG. 5A, showing successive stages in making a connection to the end of the conductor.
Figure 5C:
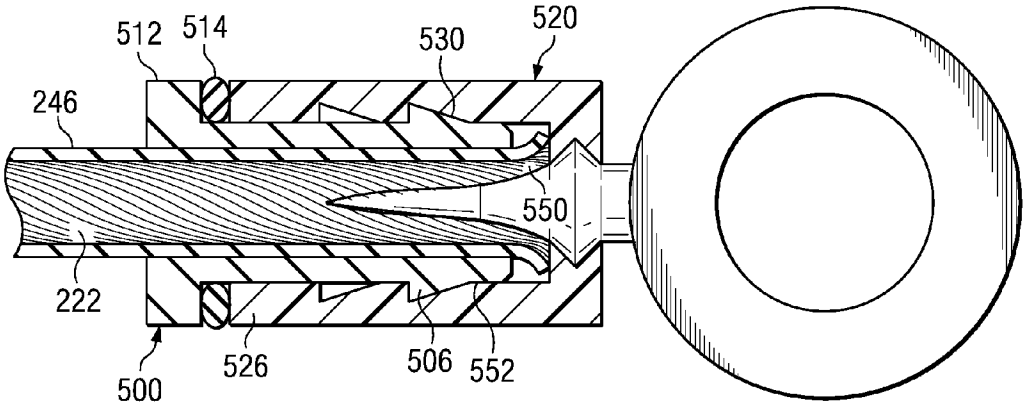

FIGS. 5A–5C show another embodiment of this invention. A cap 500 has a generally cylindrical external sidewall 502 and a cylindrical inner sidewall 504, the latter sized to receive a multistranded conductor 222. A preferably circumferential ridge 506 is formed by an upstanding annular surface 508 and a forward and inward-sloping frustoconical surface 510. The cap 500 has an enlarged axial outer end 512. Axially inwardly from the outer end 512 is an o-ring 514 which rides on the outer sidewall 502.

A connector body 520 has a generally cylindrical bore 522 that terminates in a bottom 524. The bore has an axially outer end 526 with a predetermined inner diameter that is slightly larger than that of the generally cylindrical exterior sidewall 502 of cap 500, but which is smaller than the outer diameter of ridge 506. The body 520 and/or cap 500 are preferably formed of a material having a slight elasticity, so as to allow the ridge 506 to be inserted into bore 522. While being generally cylindrical (or alternatively prismatic), the bore 522 has at least one, and preferably two, grooves 528, 530 having internal diameters which are increased from that of the general surface of bore 522, and which are each adapted to receive ridge 506 of cap 500. The topography of each groove 528, 530 should correspond to that of ridge 506, and in the illustrated embodiment each groove 528, 530 has a radially and orthogonally outwardly extending annular surface 532, joined to a radially and axially inwardly extending frustoconical surface 534. The bore 522 is provided with a conductive element 536 which includes a prong or pin 538 that extends axially outwardly from the base 524 to a point 540. The prong 538 should be sloped radially outwardly and axially inwardly, so that its diameter at the base 524 is greater than the diameter at the tip 540. The conductive element 536 can have a battery terminal connecting structure 542 as shown, but alternatively can take any other form as may be convenient to connect to electrical or electronic apparatus, such as a pin connector or a spade. In the instance that the body 522 is molded from an insulator such as injection-molded plastic, the conductive element 536 can have projections 544 which extend into the back sidewall 546 of connector body 520.

The operation of this embodiment is shown in FIGS. 5B and 5C. FIG. 5B shows cap 500 and connector body 520 in a preassembled condition in which they are preferably provided to end users. In this condition, the cap ridge 506 is detented or registered to the first groove 528. In this condition, the conductor 222 is inserted through and beyond the internal bore 504 of the cap 500 and is impaled on the prong 538. As the conductor 222 is forced on to the widening prong 538, its insulation 246 and its conductive strands 550 are forced radially outwardly. After the conductor has been so inserted, the cap 500 is advanced axially inwardly in the body bore 522, which in some embodiments can be accomplished manually but which is preferred to be accomplished by a tool (not shown) to achieve a larger and more uniform compressive force, and which can have a stop that will not permit overcompression. The cap is advanced until the ridge 506 snaps or seats into the second, axially inward groove 530 (FIG. 5C). In this position, the sidewall 552 crushes the strands 550 and the insulation 246 between itself and the sloping surface of prong 538, providing a strong physical and electrical connection. In an embodiment alternative to that shown, the inner diameter of the cap bore 504 can be chosen to be smaller than a preselected diameter taken somewhere along the prong 538. When ridge 506 is in registry with groove 530, the o-ring 514 seals the opening between enlarged cap portion 512 and the opening 526 of the body 520.

Figure 6:
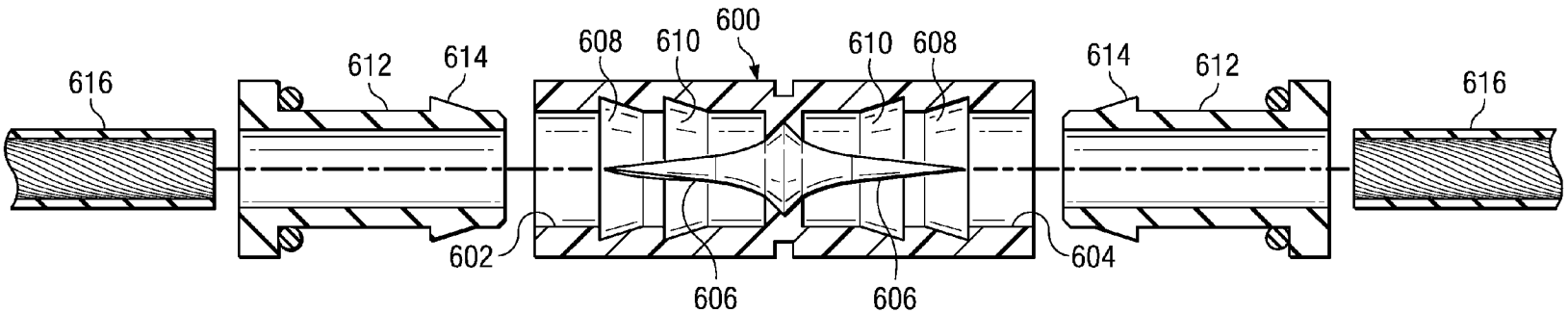
FIG. 6 is an axial sectional view of an end-to-end connector embodiment similar to the one shown in FIG. 5.

FIG. 6 shows a double-ended version of the embodiment shown in FIGS. 5A–5C. It should be understood that similar double-ended versions can be provided for the other single-ended embodiments described and illustrated herein in similar fashion. In FIG. 6, a central connector body 600 includes opposed axial bores 602, 604 each of which have a conductive prong 606, first and second circumferential grooves 608 and 610, and respective caps 612. Each cap 612 has a ridge 614 meant to be detented in one of the respective grooves 608, 610. The prongs 606 are in conductive communication with each other. This embodiment shows how the invention can be employed in a splicing rather than a terminating connector.

The number of bores 602, 604, could easily be multiplied to accept further multistranded insulated conductors 614 into a single central body (not shown). The bores could be formed in parallel as might occur in a terminal block or wiring harness, or could be formed at angles to each other as might occur in a three-way Y-connector. Further, the bore, cap and central prong could all be made oblong, so as to accept two or more conductors side by side. In another embodiment (not shown) the cap and connector body bore could be oblong, with a plurality of separately upstanding prongs positioned to pierce the ends of respective multistranded conductors.

Figure 7A:
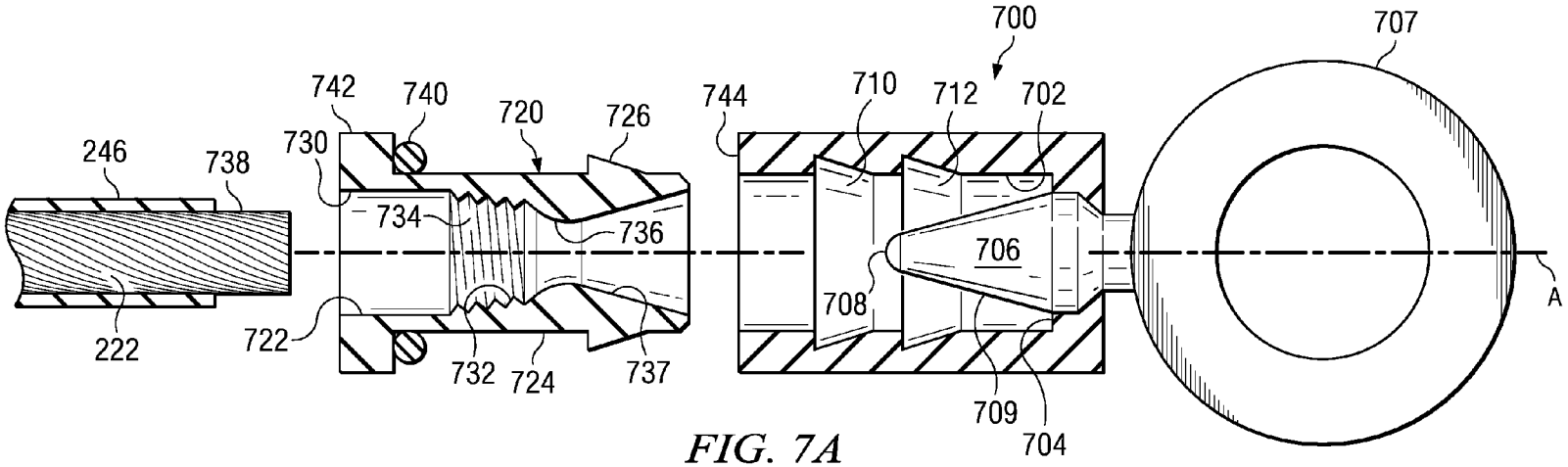
FIG. 7A is an axial sectional view of a connector body and cap according to a fifth embodiment of the invention, shown together with a multistranded insulated conductor, a terminal portion of which has had the insulation stripped away.
Figure 7B:
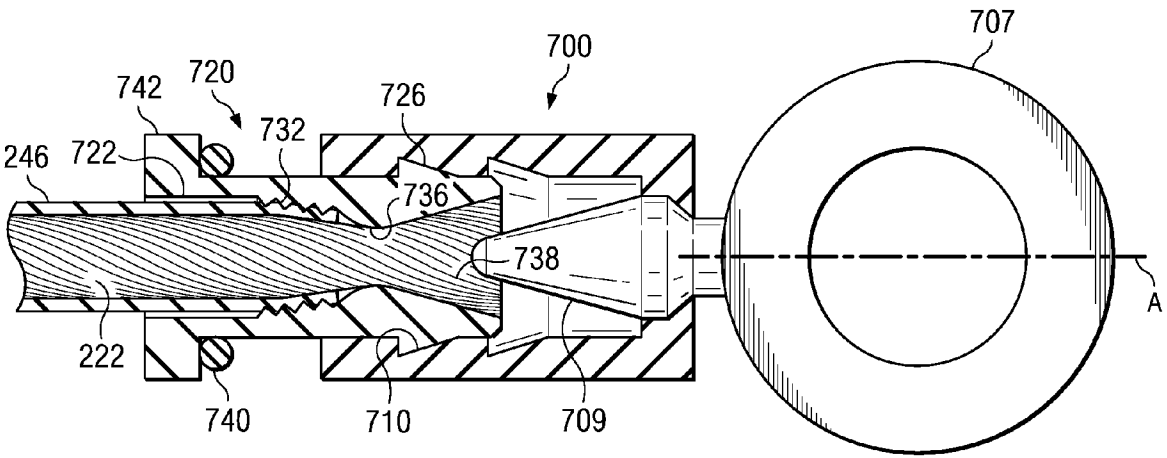
FIGS. 7B and 7C are axial sectional views of the connector body, cap and conductor shown in FIG. 7A, showing successive stages in making a connection to the conductor.
Figure 7C:
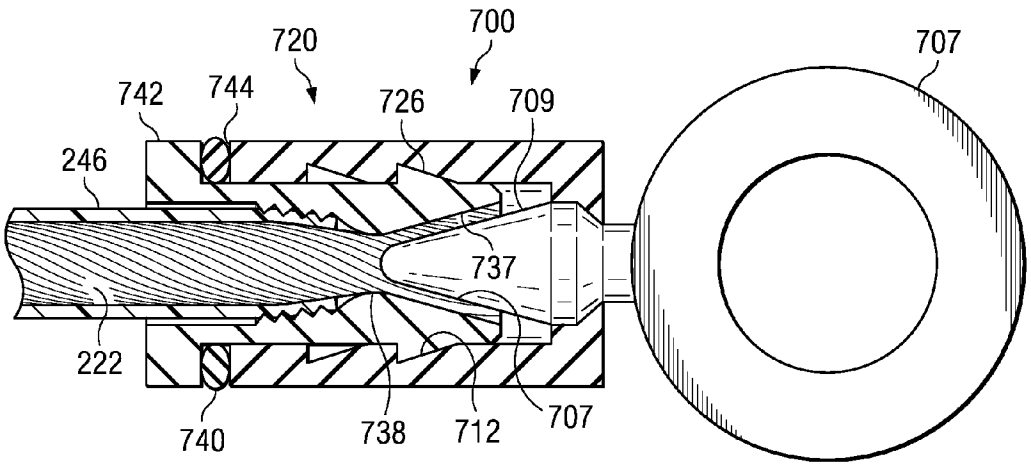

FIGS. 7A–7C illustrate a further embodiment of the invention which is a variation of the embodiment shown in FIGS. 3 and 4A–4D. In this embodiment, a connector body 700 has a generally cylindrical bore 702 with a bottom 704. A prong 706 of a conductive element 707 extends axially outwardly into the bore 702 from the bottom 704, and in this embodiment has a convexly curved surface 708 at a free end 709 thereof. While the bore 702 is generally cylindrical, it is also provided with at least one, and more preferably two, grooves 710, 712, formed at two different axial distances from the bottom 704 and the prong 706. The grooves 710, 712 are each formed by a juxtaposition of orthogonally upstanding annular surfaces and radially and axially inwardly sloping surfaces, as more fully described previously for other illustrated embodiments.

A cap 720 has an inner bore 722 and a generally cylindrical outer surface 724 which, however, includes an upstanding circumferential ridge 726. The ridge 726 is formed in such a way that it may register with either of the body bore grooves 710, 712, and is built of surfaces complementary to the surfaces making up those grooves. While the ridge and groove structures 710, 712, 726 are shown as constructed of annular and frustoconical surfaces, they can be selected otherwise, and for example can be constructed of curved surfaces. Their positions can be correspondingly displaced up and down the axis A as is convenient, since those positions are chosen independently of the conductor-connecting structures radially interior to them.

The cap bore 722 has an axially outwardly disposed end 730 with an interior diameter sized to receive a multistranded conductor 222 with its insulation 246 intact. But as one proceeds axially inwardly, the diameter of bore 722 begins to constrict. Also at this point, threads 732 appear, and are provided to threadably and sealingly engage with the conductor insulation 246. In the illustrated embodiment, the threads are placed on a linearly constricting or beveled throat 734 that provides gradually increasing resistance as the insulation 246 is threaded onto it. The frustoconical disposition of the threads 732 also permits some variation in conductor outer diameter, as any within a predetermined range will be able to be sealingly connected using this embodiment. Instead of threads 732, a plurality of nonhelical, coaxial sealing rings (not shown) could be provided, and these could have a "shark tooth" profile to permit the easy insertion of insulation 246 beyond them, but make the extraction thereof in an axially outward direction more difficult.

Axially inwardly from the threads 732 is a constriction 736, which only permits the stripped conductor strands 738 to pass through it. The exterior surface of insulation 246 may be marked so that an optimal terminal portion thereof is stripped, and/or a tool may be provided for this purpose, or the conductor 222 may be provided with one end pre-stripped together with connector components 700, 720 in kit form. After constriction 736, at some point (in this illustrated embodiment, immediately) the bore will flare out again in a circumferential beveled surface 737 that corresponds in mirror image to the surface 709 of conductive element 707. The cap 720 also has a sealing o-ring 740 which is disposed axially inwardly of a cap enlargement 742 that forms cap 720's axial outer end. The o-ring 740 will sealingly engage with an axially outer end 744 of the body 700.

The operation of this embodiment is illustrated in FIGS. 7B and 7C. In FIG. 7B, a multistranded insulated conductor 222 has had its insulation 246 stripped from a predetermined terminal portion (which may be marked in advance for stripping), leaving bare conductive strands 738. The cap 720 may be provided to the end user preassembled to the body 700, as shown, with the cap detented to the first ridge 710. After stripping the conductor 222 is threaded into cap bore 722, wherein the insulation 246 is threaded onto cap threads 732. This may be accomplished by rotating the cap 720 relative to the conductor 222. Where a series of coaxial sealing rings are used instead, the conductor 222 may simply be inserted without twisting into cap bore 722 as far as it can go. When fully engaged, the stripped portion of the conductive strands 738 will extend through the throat or constriction 736.

Once the threads 732 have fully engaged the insulation 246, the cap 720 and conductor 222 are advanced together until the cap ridge 726 snaps into or seats in second groove 712 (FIG. 7C). This compression may be accomplished manually in some embodiments and may require a tool in others. In this position the conductive strands 738 are clamped between the convex beveled surface of conductive element 707 and the concave beveled surface 737 of cap 720. This makes a secure physical and electrical connection to the conductor 222. Also in this position, the o-ring 740 will be compressed between the enlarged cap portion 742 and an axial outward end surface 744 of the connector body 700.

Figure 8:
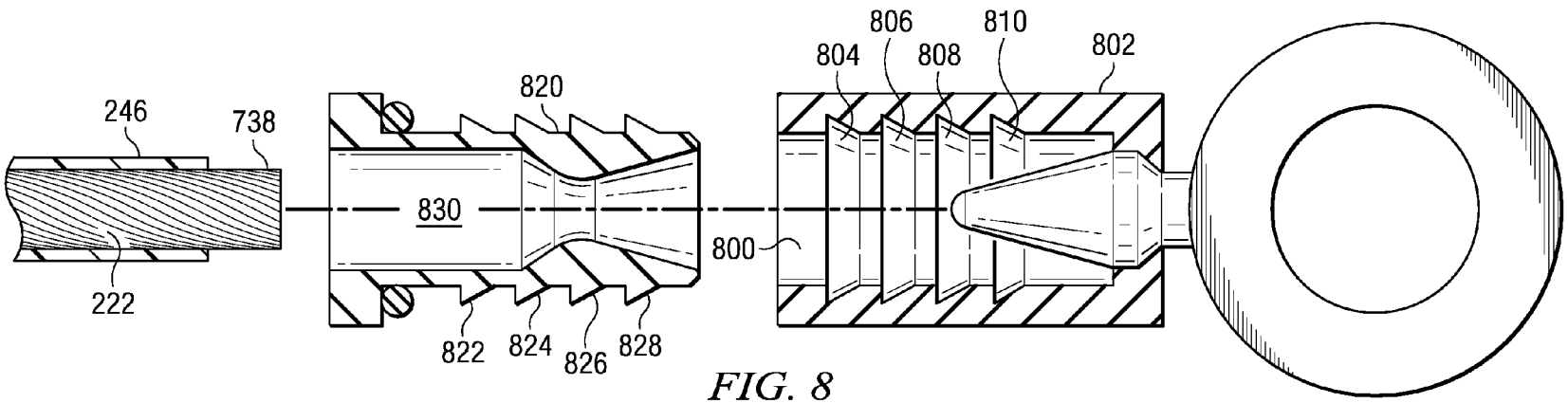
FIG. 8 is an axial sectional view of a connector body and cap according to a sixth embodiment of the invention, shown together with a multistranded insulated conductor, a terminal portion of which has had the insulation stripped away.

FIG. 8 illustrates another variation on the embodiment shown in FIGS. 3 and 4A–4D. In this embodiment, instead of just two grooves inside of a bore 800 of a connector body 802, there are multiple grooves, here shown as four such grooves 804, 806, 808 and 810 by way of example, each displaced from each other at a different axial position inside the bore 800. A cap 820 is provided with a plurality of ridges, by way of example four such ridges 822, 824, 826 and 828, each of which project radially outwardly from a general cylindrical exterior surface 830. The number of ridges on the cap 820 does not have to be the same as the number of grooves 804–810; in one embodiment (not shown), only one such ridge is provided. Each ridge 822–828 is capable of registration in one of the grooves 804–810.

This embodiment permits positioning or detenting the cap 820 at each of several axial positions inside connector body bore 800. The cap 820 may be presented to an end user as preassembled to the connector body 802, with the first ridge 828 snapped to or seated in the leading groove 804. A multistranded conductor 222, from which a terminal portion of the insulation 246 has been stripped, is inserted through the cap bore 830, as before. The cap is then compressed manually or with a tool further into the bore 800, to groove 806, 808 or even 810. The provision of several such grooves permits the connector to accept and effectively connect to a range of sizes of the conductor 222. While more than two sets of grooves 804–810 are shown as provided with an embodiment similar to that shown in FIGS. 3 and 4A–4D, more than two such grooves can also be provided in conjunction with any other embodiment of the invention.

Figure 9A:
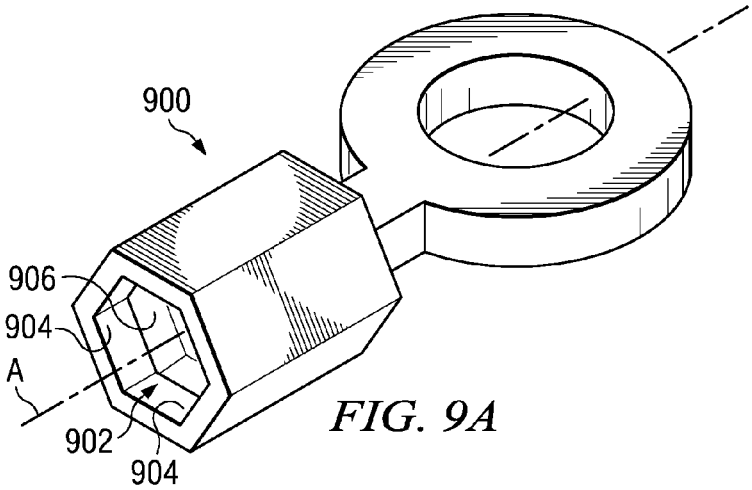
FIGS. 9A and 9B are isometric views of a connector body and cap, respectively, according to a seventh embodiment of the invention.
Figure 9B:
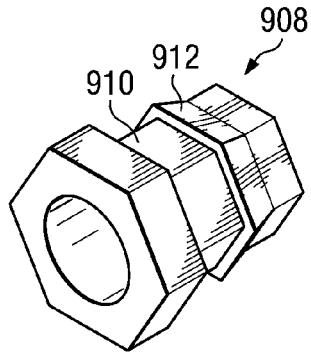

FIGS. 9A and 9B illustrate a further variation of the invention, in which a connector body 900 has a generally prismatic, rather than a generally cylindrical, bore 902. The bore or cavity 902 is shown with six sides 904 but prisms of other shapes can instead be provided, or indeed any other noncircular cross sectional shape that stays relatively constant as one proceeds down the axis A of the bore 902. Each or at least some of the sides 904 will be provided with at least one, and preferably two, grooves 906, which can have a frusto-pyramidal shape and each be formed of two planar surfaces. A cap 908 will have a generally prismatic external surface 910 which is adapted for insertion into the connector cavity 902. A preferably circumferential ridge 912, which is preferably but not mandatorily made up of another set of frustopyramidal surfaces, is adapted to register or snap into a selected one of the grooves 906. Ridge 912 and grooves 906 can be alternatively be made up of curved surfaces.

This embodiment is possible because the cap 908 fastens the conductor (not shown) in place with a straight axial movement rather than a twisting movement. Indeed, a noncylindrical embodiment such as that shown in FIGS. 9A and 9B may be preferred in those instances where torsional damage to the conductor is sought to be prevented, because the end user will be forced to insert the cap 908 into the bore 902 in an axially straight motion, and the noncircularity of the cap and the bore effectively prevent one from being twisted with respect to the other.

Figure 10A:
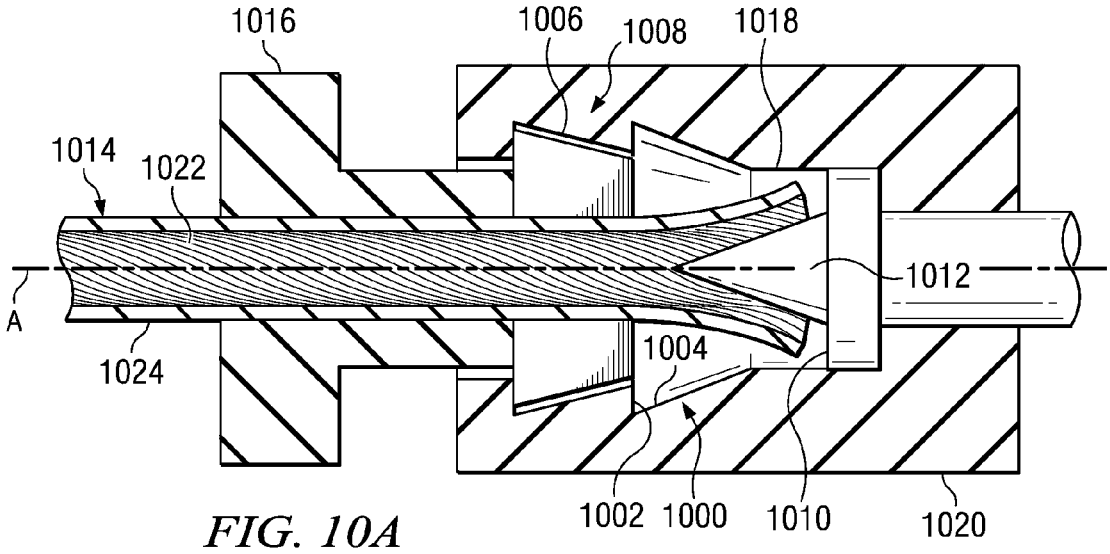
FIGS. 10A and 10B are axial sectional views of a connector body and cap according to an eighth embodiment of the invention, showing two stages in the connection to a multistranded electrical conductor.
Figure 10B:
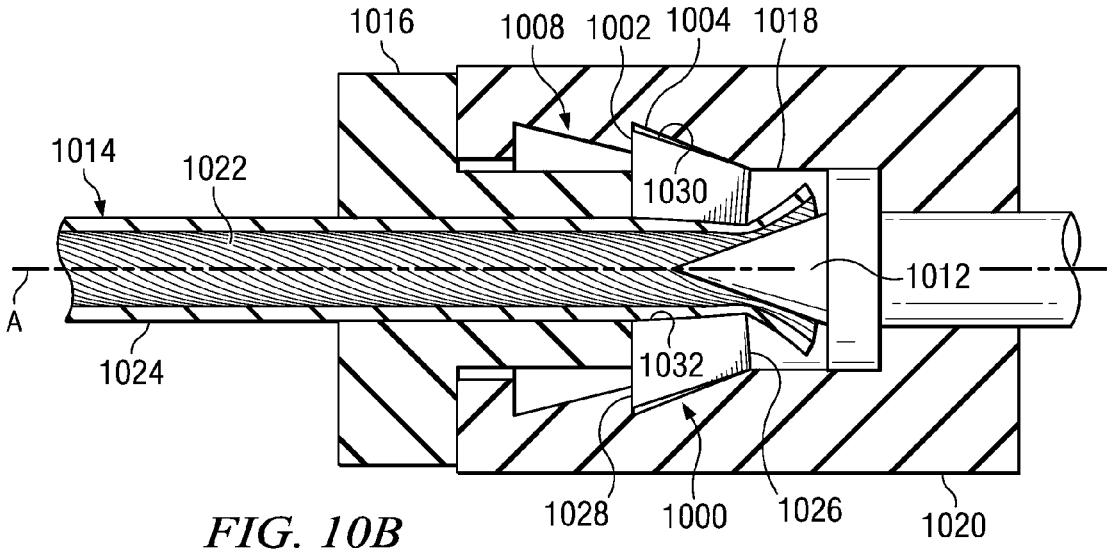

FIGS. 10A and 10B show an embodiment similar to that shown in FIGS. 1A–2F, with the following changes. The second or inner groove 1000 is formed by a straight annular surface 1002, as before, but also by a frustoconical surface 1004 that is angled more steeply than the corresponding frustoconical surface 1006 of groove 1008. That is, as one proceeds inwardly toward bore bottom 1010, points on the sloped surface 1004 approach the axis A more quickly than do corresponding points on surface 1006. The central conductive connecting element takes the form of a relatively broad-based cone 1012. In the first connection step shown in FIG. 10A, an insulated multistranded conductor 1014 is inserted through the cap 1016 and into the bore 1018 of the connector body 1020, so that the conductive strands 1022 of the conductor 1014 will be impaled on cone 1012 and will spread apart, together with insulative sheath 1024.

FIG. 10B shows the second step in making a connection. After the end of conductor 1014 has been impaled on cone 1012, the cap 1016 is advanced inwardly into the bore 1018, from the first groove 1008 to the second groove 1000. The cap 1016 has an axially inner end 1026 that has been split (similar to that shown in FIG. 1A). When the cap 1016 proceeds sufficiently down the bore 1018, the axially outward end 1028 of cap frustoconical surface 1030 will snap past the annular surface 1002. In this condition, the frustoconical surface 1030 will be cammed radially inwardly by the steep frustoconical surface 1004, causing the inner bore 1032 of the cap 1016 to compress into the conductor 1014. The inner diameter of the inner end 1026 of the cap 1016 is smaller than the base diameter of cone 1012, particularly as so cammed by connector surface 1004, so that the conductive strands 1022 and the insulation 1024 will be more firmly crushed by the interaction of cap 1016 and the central cone 1012, making for a more secure connection.

It should be understood that various features and modifications shown in only one or some of the illustrated embodiments can be easily adapted to the others. Any of the illustrated embodiments can take on a prismatic rather than a cylindrical form, and can even have irregular but substantially axially uniform cross-sections. Any of the illustrated connectors may be formed all of metal or alternatively may be largely constituted by injection-molded plastic. Most of the embodiments are suitable for connecting to uninsulated as well as insulated multistranded wire. All can be furnished in a preassembled condition to end users, or alternatively can be furnished with a cap and physically separate connector body. The connectors according to the invention may be furnished singly, or multiply and joined together as might occur where a terminal block or wiring harness has several connector body bores.

O-rings may be furnished in any of the embodiments for sealing an axially outward cap end to the connector body, and/or for sealing the inner bore of the cap to the insulation of the conductor. All illustrated connector bodies may be furnished with only one, or more than two, detenting grooves. All embodiments may be manufactured in end-to-end or Y-conductor splicing forms. The described detenting grooves and ridges can be formed by surfaces other than annuluses and frustoconical surfaces. Connectors may be provided according to the invention in which a groove is provided on the cap and one, two or more detenting ridges are provided on the sidewall of the connector body bore, in mirror image to those described. All embodiments may be provided with discontinuous instead of endless grooves and ridges, and these grooves and ridges may even include several, physically separate segments at each axial position. The conductor supplied with the connector(s) may have its insulation marked along its length to indicate a correct amount of insertion into the connector. These modifications are all within the scope of the disclosed invention.

In summary, different embodiments of a compression snap electrical connector have been shown and described, wherein preferably a ridge or groove on a cap registers with one of at least two grooves or ridges formed in the bore of the connector body.

While illustrated embodiments of the present invention have been described and illustrated in the appended drawings, the present invention is not limited thereto but only by the scope and spirit of the appended claims.

I claim:

1. An electrical connector, comprising:

a connector body having a bore with an axis and an open end having a first internal diameter, the bore having a sidewall extending generally axially inwardly from the open end to a bottom of the bore, a first groove having a beveled surface formed in the sidewall to be spaced axially inwardly from the open end of the bore and having a second internal diameter across the axis which is larger than the first internal diameter, a second groove having a beveled surface formed in the sidewall to be spaced axially inwardly from the first groove and having a third internal diameter across the axis which is larger than the first internal diameter, a conductive element formed at the bottom of the bore for electrically connecting to a multistranded conductor;

a cap having an inner axial end and an outer axial end and having a bore from the inner to the outer axial ends for accepting a multistranded insulated conductor therethrough, an outer surface of the cap including a general outer surface substantially parallel to the axis and a ridge extending radially outwardly therefrom, a beveled surface of the ridge extending from an axially outer first end thereof radially inwardly to a second end of the beveled surface closer to the axial inner end of the cap than the first end, the ridge of the cap adapted to fit into the first groove of the connector body bore and adapted to fit into the second groove of the connector body bore, the cap advanced from the first groove inwardly down the bore of the connector body to be seated in the second groove in order to electrically connect the multistranded conductor to the conductive element of the connector body, advancing the ridge of the cap axially inwardly contacting the second groove so as to compress the ridge inwardly and clamp the conductor in place.

2. The electrical connector of claim 1, wherein the first and second grooves are endless.

3. The electrical connector of claim 1, wherein the beveled surface of the first groove extends radially inwardly from a first axial outer end of the beveled surface to a second end thereof closer to the bore bottom than the first end.

4. The electrical connector of claim 3, wherein the first groove further includes a step extending from a general interior surface of the bore sidewall radially outwardly to the first end of the beveled surface.

5. The electrical connector of claim 1, wherein the beveled surface of the second groove extends radially inwardly from a first axial outer end of the beveled surface to a second end thereof closer to the bore bottom than the first end.

6. The electrical connector of claim 5, wherein the second groove further includes a step extending from a general interior surface of the bore sidewall radially outwardly to the first end of the beveled surface.

7. The electrical connector of claim 1, wherein the ridge of the cap is endless.

8. The electrical connector of claim 1, wherein the beveled surface of the ridge extends to the inner axial end of the cap.

9. The electrical connector of claim 1, wherein the ridge further includes a step formed to extend from the first end of the beveled surface of the ridge to a general outer surface of the cap.

10. The electrical connector of claim 9, wherein the step is substantially disposed in a plane orthogonal to the axis.

11. The electrical connector of claim 1, wherein the sidewall of the bore of the connector body is generally cylindrical.

12. The electrical connector of claim 1, wherein more than two grooves are formed in the sidewall of the bore of the connector body, each groove adapted to seat the ridge of the cap, each groove being disposed at a different axial position along the bore sidewall.

13. The electrical connector of claim 1, wherein the conductive element of the connector body extends axially outwardly from the bottom of the bore and is substantially coaxial with the bore, the conductive element having a free end, a sloped surface of the conductive element extending radially outwardly toward the bottom of the bore.

14. The electrical connector of claim 1, wherein the cap is preassembled to the body such that the ridge of the cap is disposed in the first groove in the bore of the body prior to use.

15. An electrical connector, comprising:

a connector body having a bore with an axis and an open end having a first internal diameter, the bore having a sidewall extending generally axially inwardly from the open end to a bottom of the bore, at least one groove formed in the sidewall to be spaced axially inwardly from the open end of the bore and having a second diameter across the axis which is larger than the first diameter, a conductive element formed at the bottom of the bore for electrically connecting to a multistranded conductor, a beveled portion of the sidewall being sloped so as to be more constricted in a direction toward the bore bottom; and a cap having an inner axial end and an outer axial end and having a bore from the inner to the outer axial ends thereof for accepting a multistranded conductor therethrough, an outer surface of the cap including a general outer surface substantially parallel to the axis and a ridge extending radially outwardly therefrom, a beveled surface of the ridge extending from a first end thereof radially inwardly to a second end nearer the axial inner end of the cap than the first end, the ridge of the cap adapted to fit into the groove of the connector body bore, slits formed in the beveled surface of the ridge to extend from the inner axial end axially outwardly, the cap advanced axially inwardly down the bore of the connector body in order to electrically connect the multistranded conductor to the conductive element of the connector body, the advancing of the cap axially inwardly contacting the slits of the ridge with the beveled surface of the bore so as to compress the sidewall of the ridge radially inwardly and clamp the conductor in place.

16. The electrical connector of claim 15, wherein said at least one groove is one of first and second grooves formed in the sidewall of the bore of the connector body, the second groove being axially inwardly spaced from the first groove, the slits of the cap contacting a beveled surface of the second groove in order to compress the sidewall of the cap radially inwardly to clamp the conductor in place.

17. The electrical connector of claim 15, wherein said at least one groove is endless.

18. The electrical connector of claim 15, wherein the ridge of the cap is endless.

19. The electrical connector of claim 15, wherein said at least one groove is substantially disposed in a plane orthogonal to the axis.

20. The electrical connector of claim 15, wherein the ridge of the cap is substantially disposed in a plane orthogonal to the axis.

21. The electrical connector of claim 15, wherein four said slits are formed in the cap.

22. A method of connecting an electrical connector to a multistranded electrical conductor, comprising the steps of:

providing a connector body having a bore with first and second grooves having beveled surfaces axially spaced from an end of the bore, the second groove axially inwardly spaced from the first groove away from the end of the bore;

providing a cap with a bore therethrough and a ridge having a beveled surface on an external surface of the cap which is capable of registration with either the beveled surface of the first groove of the connector body or the beveled surface of the second groove of the connector body;

preassembling the cap to the connector body by seating the beveled surface of the ridge of the cap adjacent to the beveled surface of the first groove of the connector body bore;

inserting a conductor to be connected into the bore of the cap and into the bore of the connector body; and advancing the ridge of the cap from the first groove in the bore to the second groove in the bore to register the beveled surface of the ridge with the beveled surface of the second groove in order to effect an electrical connection to the conductor by clamping.

* * * * *